US007258833B2

(12) United States Patent
Rainey et al.

(10) Patent No.: US 7,258,833 B2
(45) Date of Patent: Aug. 21, 2007

(54) HIGH-ENERGY CASCADING OF ABRASIVE WEAR COMPONENTS

(75) Inventors: Allan William Rainey, Mansfield, TX (US); John Franklin Kita, Greensburg, PA (US)

(73) Assignee: Varel International Ind., L.P., Carrollton, TX (US)

( * ) Notice: Subject to any disclaimer, the term of this patent is extended or adjusted under 35 U.S.C. 154(b) by 473 days.

(21) Appl. No.: 10/657,896

(22) Filed: Sep. 9, 2003

(65) Prior Publication Data

US 2005/0053511 A1 Mar. 10, 2005

(51) Int. Cl.
*B22F 3/24* (2006.01)
*B24B 1/04* (2006.01)

(52) U.S. Cl. ..... 419/18; 419/28; 451/37; 451/57; 451/327; 451/330

(58) Field of Classification Search ..... 419/18, 419/28; 451/32, 177, 327, 330
See application file for complete search history.

(56) References Cited

U.S. PATENT DOCUMENTS 4,235,051 A * 11/1980 Spekman, Jr. ..... 451/35
4,307,544 A * 12/1981 Balz ..... 451/32
4,705,594 A * 11/1987 Zobbi et al. ..... 216/90
4,869,329 A 9/1989 Kar et al. ..... 175/57
5,507,685 A * 4/1996 Hoffman ..... 451/34
5,672,094 A * 9/1997 Nishimura et al. ..... 451/32
6,875,081 B2 * 4/2005 Hoffman ..... 451/32

FOREIGN PATENT DOCUMENTS

GB 1249056 10/1971
GB 1515532 6/1978
JP 61270331 11/1986

OTHER PUBLICATIONS

"*High Energy Centrifugal Barrel Finishing Machine*" Victor Metal Finishing Co.., Inc. of Hollywood, Florida.
PCT Notification of Transmittal of the International Search Report and the Written Opinion of the International Searching Authority, or the Declaration mailed Feb. 4, 2005, re PCT/US 2004/029331 filed Sep. 9, 2004 (13 pages).

* cited by examiner

*Primary Examiner*—Roy King
*Assistant Examiner*—Ngoclan T. Mai
(74) *Attorney, Agent, or Firm*—Gardere Wynne Sewell LLP

(57) ABSTRACT

In accordance with the present invention, a method for manufacturing tungsten carbide components is provided. The method includes forming a composite material out of tungsten carbide powder and binder powder, pressing the composite material into a plurality of components, heating the plurality of components, optionally under pressure, to liquefy the binder, cooling the plurality of components until the binder solidifies, optionally grinding each of the plurality of components to a desired size, and cascading the plurality of components in a cascading machine under high energy conditions.

40 Claims, 4 Drawing Sheets

FIG. 2
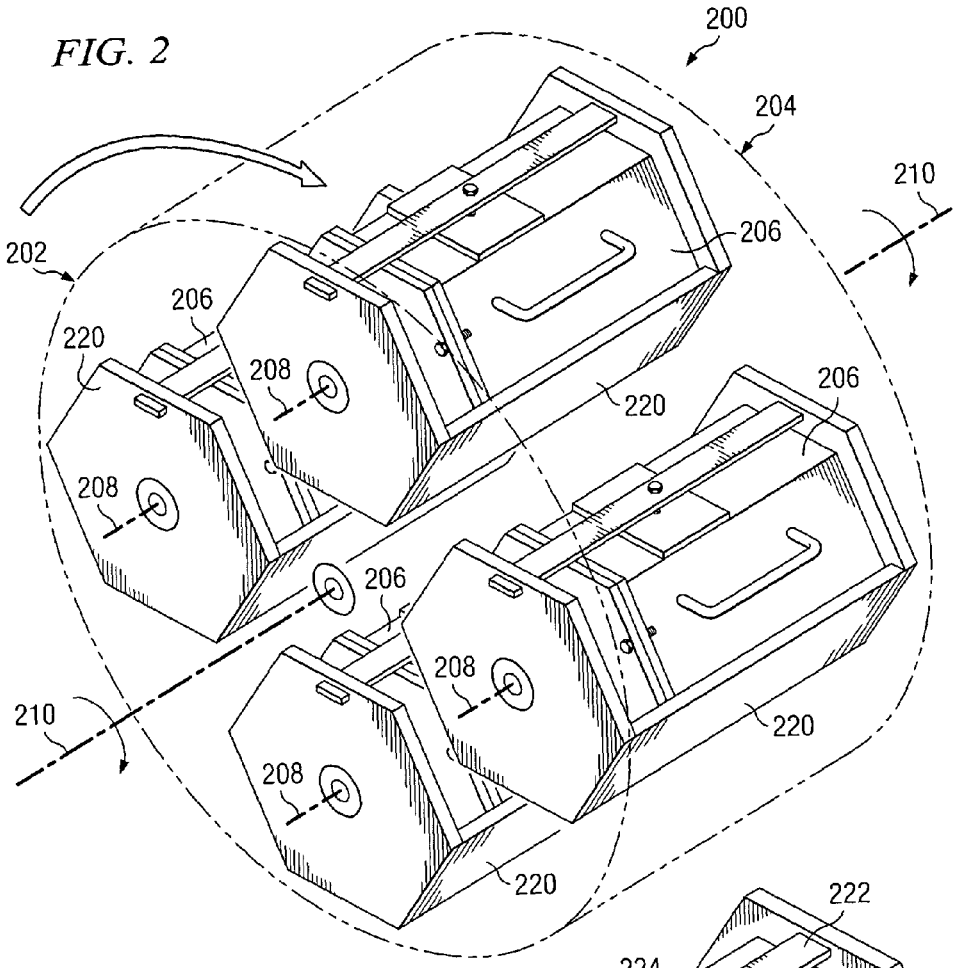
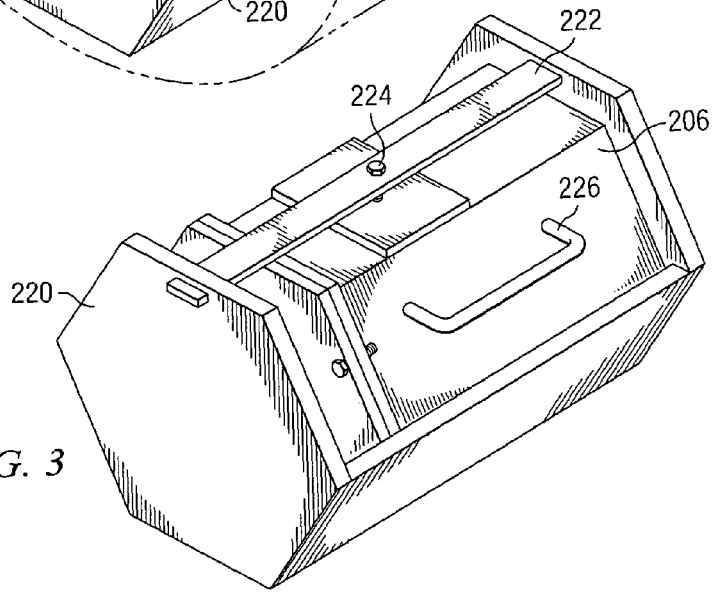
FIG. 3

HIGH-ENERGY CASCADING OF ABRASIVE WEAR COMPONENTS

TECHNICAL FIELD OF THE INVENTION

The present invention relates in general to abrasive wear components and, in particular, to the high-energy cascading of abrasive wear components.

BACKGROUND OF THE INVENTION

Abrasive wear components, such as tungsten carbide components, are used in a variety of applications where high hardness and toughness are often desired traits. These include drilling, where cemented abrasive inserts are used in numerous drill bits, and even ballistics, where cemented abrasive tips are used on armor-piercing ammunitions.

Typically, abrasive wear components are formed by combining grains of an abrasive material, such as tungsten carbide, with a binder material, such as cobalt, to form a composite material. This composite material is pressed into a desired shape and heated, sometimes under pressure, such that the binder material liquefies and cements the grains of abrasive material together. The cemented abrasive component is then allowed to cool and ground to shape. The component may also be subjected to a low-energy cascading, or tumbling, process to improve the surface finish of the component. Oftentimes, this involves tumbling the component along with other components in a mixture of liquid and abrasive material, or detergent. Some processes use attritor balls in place of, or in addition to, the abrasive material or detergent.

In contrast to this low-energy cascading, high-energy cascading has been used rarely in industrial applications, such as finishing cemented abrasive components. Instead, most high-energy cascading has been limited to polishing various objects, such as dental implants, and has only been used to improve the surface finish of an object, not to change its physical properties.

SUMMARY OF THE INVENTION

In accordance with the present invention, a method for manufacturing tungsten carbide components is provided. The method comprises forming a composite material out of tungsten carbide powder and binder powder, pressing the composite material into a plurality of components, heating the plurality of components to liquefy the binder, cooling the plurality of components until the binder solidifies, optionally grinding each of the plurality of components to a desired size, and cascading the plurality of components in a high-energy cascading machine.

Technical advantages of particular embodiments of the present invention include a method of cascading tungsten carbide components that increases the near surface hardness and toughness of the components. This prevents or reduces chipping, cracking, and/or fracture of the components and increases wear resistance.

Another technical advantage of particular embodiments of the present invention is a method of cascading tungsten carbide components that improves the surface finish of the components and reduces the size of asperities on the surfaces of the components. This smooth finish reduces the likelihood of stress concentrations accumulating on the surfaces of components Yet another technical advantage of particular embodiments of the present invention is a method of cascading tungsten carbide components that increases the surface hardness of the components such that rather than being uniform, the hardness profile of the inserts increases towards the surface of the inserts.

Another technical advantage of particular embodiments of the present invention is a method of cascading tungsten carbide components that exposes latent defects in the inserts, such as below surface level voids and cracks that were previously difficult or impossible to detect using visual inspection techniques.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following descriptions, taken in conjunction with the accompanying drawings, in which:

FIG. 2 illustrates an isometric view of the spindle of the cascading machine shown in FIG. 1;

FIG. 3 illustrates an isometric view of a barrel and cradle of the cascading machine shown in FIG. 1;

DETAILED DESCRIPTION OF THE INVENTION

Figure 1:
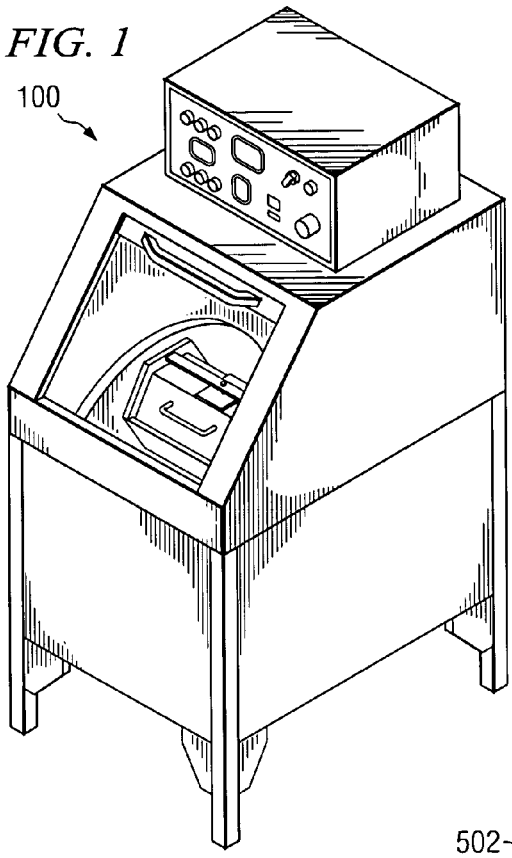
FIG. 1 illustrates an isometric view of a cascading machine used in a high-energy cascading process in accordance with a particular embodiment of the present invention.

FIG. 1 illustrates cascading machine 100 in accordance with a particular embodiment of the present invention. Cascading machine 100 is a cascading machine that may be used in a high-energy process to cascade, or tumble, abrasive wear components such that the toughness and hardness of the components may be increased. Examples of such a high-energy cascading machine include centrifugal barrel finishing machines, such as Surveyor D'Arts Wizard Model 4. Inside cascading machine 100, abrasive wear components are repeatedly collided with each other with such force that the surfaces of the components are plastically deformed, creating residual compressive stresses along the surfaces of the components. This is accomplished by placing the components within a plurality of barrels, placing the barrels within the spindle of the cascading machine 100 (which may be belt-driven, chain-driven, or directly-driven), and cascading the barrels under high-energy conditions. The compressive stresses that result from this process increase the toughness and hardness of the components by increasing the threshold level of stress necessary to fracture or deform the components. This higher threshold prevents or reduces the likelihood of chipping, cracking, and/or fracture of the components. Moreover, the increased surface hardness also increases the wear resistance of the components.

A better understanding of the internal operation of cascading machine 100 may be had by making reference to FIG. 2, which illustrates spindle 200 in more detail.

As shown in FIG. 2, spindle 200 includes first plate 202 and second plate 204, which are disposed generally parallel with, and spaced apart from, one another.

Disposed radially between first plate 202 and second plate 204 are a plurality of hexagonal cradles 220. As illustrated in FIG. 2, four cradles 220 are shown. However, it should be recognized by one skilled in the art that other numbers of cradles may also be used, although it is preferable that the cradles be arranged such that spindle 200 is balanced upon rotation. Furthermore, it should also be recognized that cradles 220 may feature shapes other than hexagonal and still be within the teachings of the present invention.

As best shown in FIG. 3, each cradle 220 is approximately hexagonal and is configured to receive a single hexagonal barrel 206. Once placed in cradle 220, hexagonal barrel 206 is secured in place using bolt 224 to rigidly couple barrel 206 to clamp bar 222. To assist in the placement of barrel 206 within the cradle 220, each barrel 206 includes at least one handle 226. Furthermore, it should be recognized that barrels 206, like cradles 220, need not be hexagonal, and may feature shapes other than hexagonal and still be within the teachings of the present invention.

The volume of each barrel 206 may be selected to control the amount of energy the components are exposed to during the high-energy cascading process. Therefore, depending on the particular application (e.g., material grade, size, density, geometry, and desired finish of the components being cascaded), the size of the barrels 206 may be modified to result in a selected level of energy imparted to the components during cascading. In particular embodiments of the present invention, one method of modifying the volume of each barrel 206 utilizes an insert, or liner, placed inside the barrel 206 to reduce the inner volume to the desired size. As with the size of the barrel, the size of this liner may be selected based upon the application, taking into account the size, density, quantity, and desired finish of the components to be cascaded. An example of such a liner is illustrated in FIGS. 4A-4C.

Figure 4A:
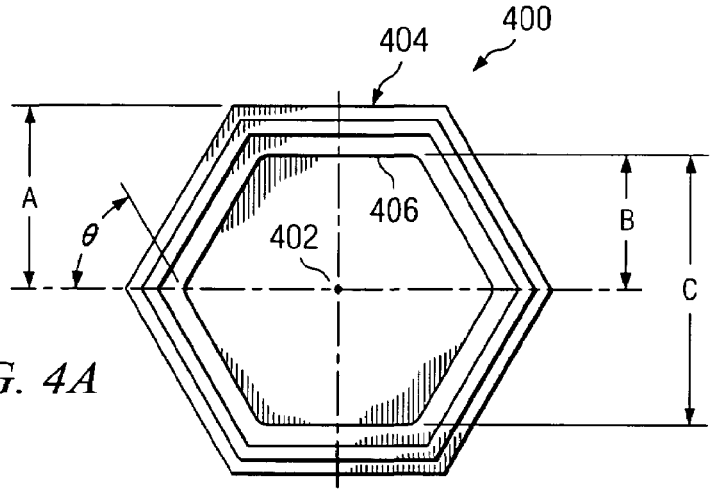
FIG. 4A illustrates a top view of a liner that may be placed in a barrel used in a cascading machine in accordance with a particular embodiment of the present invention to reduce the internal volume of the barrel.

As shown in FIG. 4A, liner 400 has a generally hexagonal shape, with each wall of the liner forming an angle θ with the adjacent walls. Typically, this angle θ is approximately 60 degrees. In particular embodiments of the present invention, the distance between the longitudinal axis 402 of liner 400 and the middle of the edge of the lip 404, distance A, may be approximately 3.475 inches. The distance between the longitudinal axis 402 of liner 400 and the middle of each of the interior walls 406, distance B, may be approximately 2.857. This results in the distances between opposite interior walls 406, denoted as dimension C, being approximately 5.715 inches.

Figure 4B:
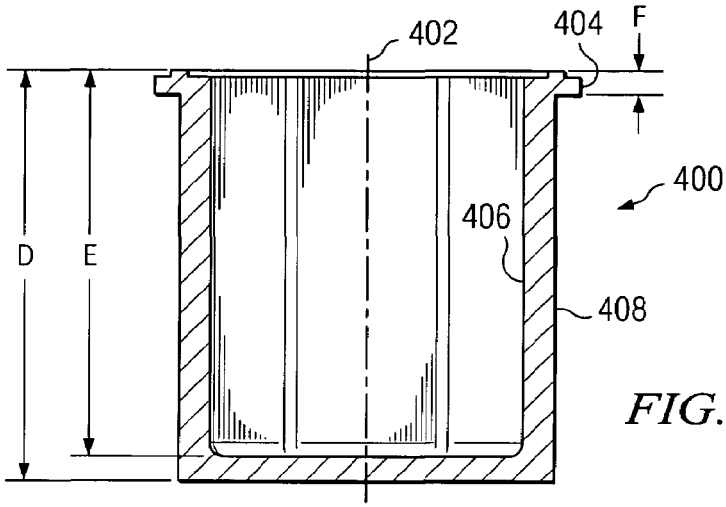
FIG. 4B illustrates a cut-away side-view of the liner shown in FIG. 4A.

FIG. 4B illustrates a cut-away side view of liner 400. As shown in FIG. 4B, liner 400 has a longitudinal height D and depth E. In particular embodiments of the present invention, height D may be approximately 7.950 inches, while depth E may be approximately 7.450 inches. Lip 404 has a height F of approximately 0.450 inches.

Figure 4C:
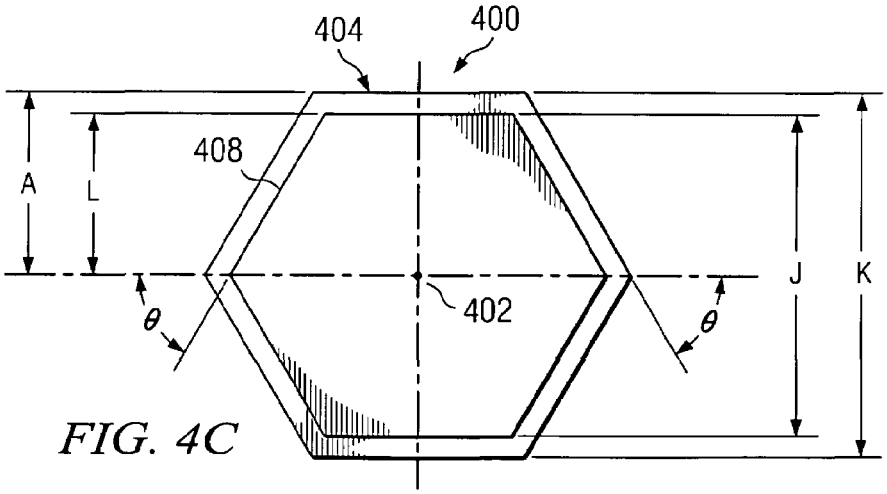
FIG. 4C illustrates a bottom view of the liner shown in FIGS. 4A and 4B.

Another view of liner 400 is shown in FIG. 4C, which illustrates a bottom view of liner 400. As shown in FIG. 4C (and also in FIG. 4A), the distance between the longitudinal axis 402 of liner 400 and the middle of the edge of lip 404, distance A, may be approximately 3.475 inches. This results in liner 400 having a total width K of 6.950 inches. The distance between longitudinal axis 402 and the middle of each exterior wall 408 of liner 400 is denoted as dimension L. In particular embodiments of the present invention, dimension L may be approximately 2.975 inches, resulting in a total distance between opposite exterior walls 408, denoted dimension J, of approximately 5.950 inches. Thus, in the described embodiment, the lip 404 extends approximately 0.500 inches on each side of liner 400.

It should be recognized, however, that these dimensions are provided for illustrative purposes only and are not intended to limit the scope of the present invention. One of ordinary skill in the art should recognize that liner 400 may have other dimensions and still be within the teachings of the present invention.

Referring back to FIG. 2, to prevent damage to spindle 200 or high-energy cascading machine 100, the plurality of cradles 220 are equally spaced around, and from, axis 210. Therefore, in the embodiment illustrated in FIG. 2, each of the four cradles 220 has another cradle 220 positioned opposite it on the other side of axis 210. However, it should be recognized that other, asymmetrical orientations of cradles 220 may be employed within the teachings of the present invention provided spindle 200 does not rotate off-balance and damage high-energy cascading machine 100 as a result.

As shown in FIG. 2, each cradle 220 is axially secured to plates 202 and 204 along the longitudinal axis 208 of the cradle. Therefore, when spindle 200 is rotated around its longitudinal axis 210, the motion of the cradles/barrels is irrotational to axis 210. Instead, as spindle 200 rotates around its longitudinal axis 210, cradles 220 are translated around the axis 210, yet maintain their general upright orientation (i.e., the cradles does not rotate relative to their individual longitudinal axes 208). This results in a cascading effect, not unlike that seen in a Ferris wheel.

Under the high-energy conditions of particular embodiments of the present invention, cascading machine 100 may be operated at a spindle speed of approximately 100 to greater than 300 RPM. The exact speed within this range may be chosen according to the mass of the individual components being cascaded such that the kinetic energy of the components within the barrels is maximized without damaging the components. Components having a smaller mass are cascaded at higher spindle speeds, while components having a larger mass are cascaded at lower speeds. With this in mind, the optimal time and optimal speed for the high-energy process will vary depending on the material grade, size, density, geometry, and desired finish of the component being cascaded.

By cascading abrasive wear components in a high-energy cascading machine, such as cascading machine 100, particular embodiments of the present invention offer the ability to increase the toughness, or resistance to fracture, of the components. For example, particular embodiments of the present invention may substantially increase the hardness and toughness of the components being cascaded, in some cases increasing the near surface hardness of tungsten carbine components by 0.4 to 1.6 HRa. In some cases, an increase in near surface hardness of 2.0 HRa was achieved, although some components experienced edge chipping before this increase was achieved. Similarly, toughness may be increased 2 to 2.5 times the unprocessed value. This is due to the fact that the cascading motion of the components inside barrels 206 and the high rotational speeds of spindle 200 generate numerous forceful collisions between the components within the barrels. These forceful collisions plastically deform the binder near the surfaces of the components, inducing residual compressive stresses along the surfaces of the components. These residual compressive stresses along the surface of each component increase the threshold stress required to fracture the component, increasing the component's toughness. The residual compressive stresses that result from the high-energy cascading also serve to increase the surface hardness, or resistance to deformation, of the components for a similar reason. Additionally, the cascading process actually induces an increasing hardness profile in the components, meaning the hardness of the components is higher at the surface of the components than at the center of the components.

In particular embodiments of the present invention, the high-energy cascading also helps to improve the surface finish of the components, removing asperities and other sources of roughness that could give rise to stress concentrations on the surfaces of the components. Furthermore, the high-energy cascading results in the increasing and blending of edge radii of the components.

An additional benefit of particular embodiments of the high-energy cascading process is the identification of latent and sub-surface defects that were previously difficult or impossible to detect using typical visual inspection techniques. Examples of these defects include sub-surface voids and surface cracks that were difficult to detect prior to cascading. By subjecting the component to the high-energy cascading, these defects are magnified such that they can be identified prior to using the components in their intended applications, saving both time and money spent replacing the components at a later time.

Of course, exposing the components to this high-energy cascading process such that the surfaces of the components are plastically deformed may also induce a small diameter change in the component. For example, particular embodiments of the present invention may result in a total diameter change of 0.00020-0.00040 inches (0.00010-0.00020 inches per side) for tungsten carbide components. Therefore, this potential reduction in size should be taken into account when grinding the component to size prior to the cascading process. This is especially true for components that are used in equipment where tolerances are very small, such as tungsten carbide inserts used in rotary cone drill bits.

Figure 5:
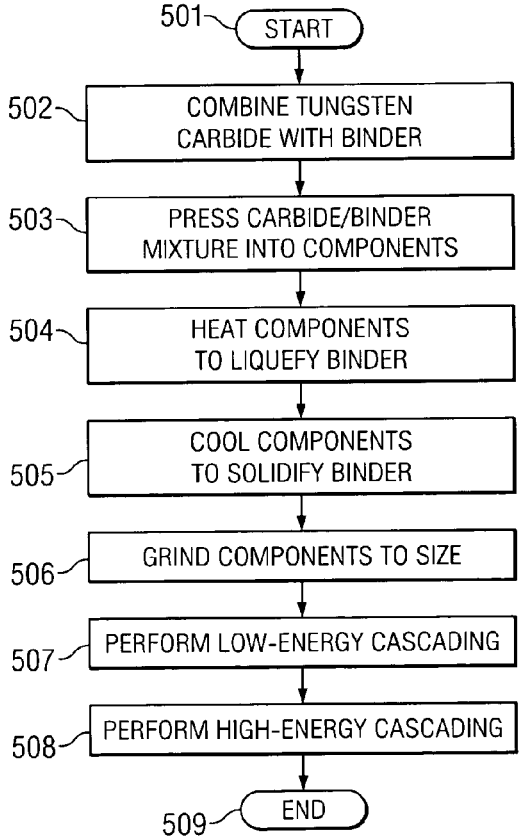
FIG. 5 illustrates a flowchart of a method of forming and finishing tungsten carbide components in accordance with a particular embodiment of the present invention.

FIG. 5 illustrates a flowchart of a method of forming and finishing tungsten carbide components in accordance with a particular embodiment of the present invention. As previously discussed, tungsten carbide components are actually a composite material comprising both tungsten carbide and a binder material, such as cobalt. Therefore, after starting in block 501, tungsten carbide powder, a lubricant such as wax, and a binder powder are combined in block 502 to form a composite material.

The carbide/binder mixture is then pressed into the shape of a desired component in block 503. The surface tension of the carbide/binder mixture allows the component to maintain the desired shape at this stage of the process.

The components are then heated in block 504 to liquefy the binder. In particular embodiments of the present invention, this may be performed under pressure by heating the components in a furnace that is also a pressure vessel. In this process, the components are heated such that the binder thoroughly wets the tungsten carbide particles, while the addition of the gas pressure helps to close any voids that may exist within the components. Thus, it should be recognized that "heating" the components also includes sintering the components, which is the process of bonding and full densification of tungsten carbide or another abrasive material with a binder, such as cobalt, during heating. A number of methods may be used to sinter the components, including hydrogen sintering, vacuum sintering, a combination of vacuum and hot isostatic sintering, high or low pressure sintering, and a combination of vacuum pre-sintering.

Following heating, the tungsten carbide components are allowed to cool in block 505. This allows the binder to solidify and form a metallurgical bond with the tungsten carbide particles, resulting in the formation of a cemented carbide.

Once the components have cooled, the components may be ground to size in block 506. Typically, the components are ground to size using a centerless diamond grinder, although it should be recognized that other grinding processes may also be used.

Figure 6:
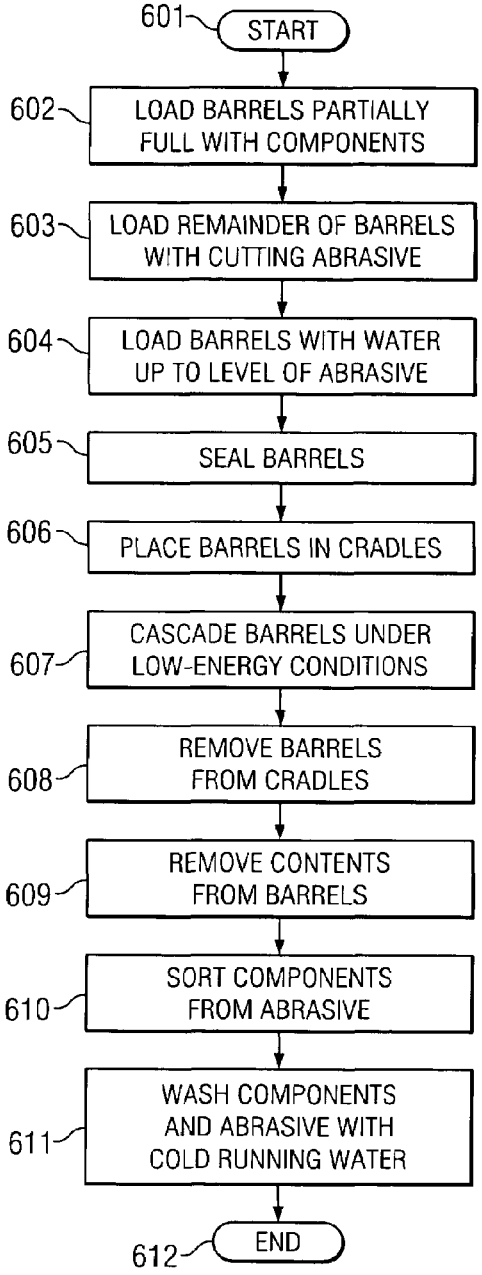
FIG. 6 illustrates a flowchart of a low-energy cascading process in accordance with a particular embodiment of the present invention.

Having been ground to size in block 506, the component may then be optionally cascaded in a low-energy process in block 507 to remove the sharp edges and improve the surface finish of the components. An example of such a process is illustrated in FIG. 6.

The components are then cascaded in a high-energy process in block 508. This process operates at high speeds (e.g., approximately 100-300 RPM) and for a short period of time (e.g., approximately 10-90 minutes).

Although the above-described method listed the steps of grinding and cascading the components as occurring in a particular order, it should be recognized that these steps may be interchanged and still be within the teachings of the present invention. Moreover, a process may entirely eliminate the steps of grinding and low-energy cascading and still be within the teachings of the present invention.

Moreover, although the above-described method describes the process of manufacturing tungsten carbide components, it should be recognized that the process is not limited to tungsten carbide components, but instead may include the manufacturing of other cemented abrasive components where grains of abrasive are held together by a binder such as cobalt, nickel, iron alloys, and/or combinations of the above. Thus, the teachings of the present invention extend to polycrystalline diamond (PCD), and other cemented abrasive components, as well as tungsten carbide components.

Similarly, it should be recognized that the process may be operated at speeds higher than 300 RPM or times less than 10 minutes and still be within the teachings of the present invention. For example, ⅝ inch diameter, cemented tungsten carbide/cobalt (5 to 6 microns grain size, 10% cobalt) inserts exhibited marked increases in hardness and toughness after as little as 10 minutes of low-energy cascading and 20 minutes of high-energy cascading at 200 RPM.

Figure 7:
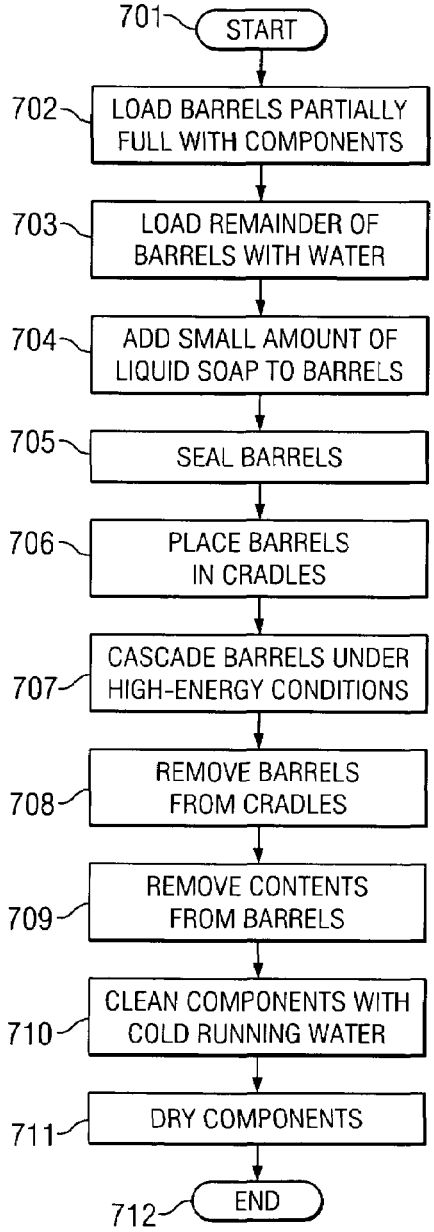
FIG. 7 illustrates a flowchart of a high-energy cascading process in accordance with a particular embodiment of the present invention.

By cascading the components under these high-energy conditions, both the toughness and hardness of the components may be increased. The high-energy cascading further helps to improve the surface finish of the components and remove or reduce the size of surface asperities. The high-energy cascading also helps to reveal latent defects in the components, such as voids and/or cracks that previously may not have been detected using typical visual inspection techniques. In addition, the high-energy cascading process also increases the surface hardness of the component such that the hardness profile of the component increases as it approaches the surface of the component. An example of such a high-energy cascading process is illustrated in FIG. 7. With the high-energy cascading complete, the flowchart terminates in block 509.

As mentioned above, FIG. 6 illustrates a flowchart of a low-energy cascading process that may be used as a precursor to a high-energy cascading process in accordance with a particular embodiment of the present invention. Although a separate low-energy cascading process is eschewed by particular embodiments of the present invention, it should be recognized that the high-energy cascading process of the present invention may be preceded, or even followed, by a low-energy cascading process and still be within the teachings of the present invention.

After the process begins in block 601, the components to be "cut" are loaded into the barrels of a cascading machine in block 602. Each barrel is loaded with components until the barrels are approximately 40% full. A cutting abrasive is then added to the barrels in block 603 until only approximately 2 inches of clearance remains at the top of each barrel. This clearance ensures that the barrels are not overfilled with components and abrasive, which could inhibit the cascading process. Water is then added to each barrel in block 604 until the level of the water reaches the level of the abrasive.

With the components, abrasive, and water loaded in the plurality of barrels, each barrel is sealed in block 605 and placed in a cradle in the spindle of the cascading machine in block 606. In order to prevent damage to the cascading machine, these barrels should be placed in the cradles of the machine such that they are counterbalanced. Therefore, each barrel should be run with a similarly weighted barrel in the opposite cradle of the spindle. If such a similarly weighted barrel isn't available, a barrel of ballast may be run in its place.

With the barrels in place in the spindle, the cascading machine is operated under low-energy conditions in block 607 in what is known as a "cut cycle". This helps to remove sharp edges from the components and improve their surface finish. An example of typical operating conditions for the cut cycle includes cascading the components for 20 minutes at 200 RPM.

Once the cut cycle is complete, the barrels are removed from the cradles in block 608 and their contents removed in block 609. In so removing the contents from the barrels, one should take care in opening the barrels, as even under low-energy conditions considerable heat and pressure may have built up in the barrels.

The contents of the barrels are then sorted in block 610. This may be performed using sorting trays or shaker screens, which allow the abrasive to pass through the trays or screens, while collecting the components. With the components separated from the abrasive, both the components and the abrasive are washed (separately) with cold running water. Washing the components helps to remove any residual abrasive, while washing and retaining the abrasive allows the abrasive to be reused in multiple cascading runs.

With the low-energy cascading process complete, the abrasive wear components may then be subjected to a high-energy cascading process, as is illustrated in FIG. 7.

FIG. 7 illustrates a flowchart of a high-energy cascading process in accordance with a particular embodiment of the present invention.

The high-energy cascading process begins in block 701. After the process begins in block 701, the components to be cascaded are loaded into the barrels of a cascading machine in block 702. Each barrel is loaded with components until the barrels are approximately 40% full. Water is then added to the barrels in block 703 until only approximately 2 inches of clearance remains at the top of each barrel. A small amount of detergent or liquid soap (e.g., approximately 1 oz.) is then added to each barrel in block 704, before the barrels are sealed in block 705.

With the barrels loaded and sealed, the barrels are placed and secured in the cascading machine cradles in block 706. As mentioned above in regard to the low-energy cascading process, in order to prevent damage to the cascading machine, these barrels should be placed in the machine such that they are counterbalanced. Therefore, each barrel should be run with a similarly weighted barrel in the opposite cradle of the spindle. If such a similarly weighted barrel isn't available, a barrel of ballast may be run in its place.

With the barrels in place in the spindle, the cascading machine is operated under high-energy conditions in block 707. Under these high-energy conditions, the cascading machine is typically operated at a spindle speed of approximately 100 to 300 RPM, depending on the mass of the individual components, as discussed above, for approximately 10 to 90 minutes. This results in the components impacting each other (and the interior walls of the barrels) with such force that the surface of the components is plastically deformed, inducing residual compressive stresses on the surfaces of the components, as previously discussed.

Once the cascading is complete, the barrels are removed from their cradles in block 708 and the contents removed in block 709. As with the low-energy process, one should take care in opening the barrels, as considerable heat and pressure may be generated in the barrels during cascading.

The components are then washed with clean running water in block 710 to remove any residue that may have built up on the components during cascading, and dried in block 711, before the process terminates in block 712.

Although particular embodiments of the method and apparatus of the present invention have been illustrated in the accompanying drawings and described in the foregoing detailed description, it will be understood that the invention is not limited to the embodiments disclosed, but is capable of numerous rearrangements, modifications, and substitutions without departing from the spirit of the invention as set forth and defined by the following claims.

What is claimed is:

1. A method for manufacturing cemented tungsten carbide components, comprising:

forming a composite material out of tungsten carbide powder and binder powder;

pressing the composite material into a plurality of components;

heating the plurality of components under pressure to liquefy the binder;

cooling the plurality of components until the binder solidifies;

cascading the plurality of components in a cascading machine in a low-energy processing media including an abrasive under low-energy conditions; and cascading the plurality of components in the cascading machine in a high-energy processing media different from the low-energy media which does not include an abrasive under high-energy conditions.

2. The method of claim 1, wherein the cascading machine is operated at a spindle speed of approximately 100 to 300 RPM during the high-energy conditions.

3. The method of claim 2, wherein the spindle speed is selected based upon an average mass of the plurality of components.

4. The method of claim 1, wherein the plurality of components is cascaded for approximately 20 minutes in the low-energy processing media and approximately 10 to 90 minutes in the high energy processing media.

5. The method of claim 1, wherein the cascading machine comprises a plurality of barrels radially disposed around a spindle, each of the plurality of barrels being configured to contain at least a fraction of to plurality of components.

6. The method of claim 5, wherein each of the plurality of barrels is axially, irrotationally coupled about a axis of to barrel parallel to a central axis of the spindle.

7. The method of claim 5, wherein the plurality of barrels comprise hexagonal barrels.

8. The method of claim 5, further comprising selecting a volume of each of the plurality of barrels to control the amount of energy imparted to the plurality of components within the plurality of barrels.

9. The method of claim 5, wherein cascading the plurality of components under high-energy conditions comprises placing the plurality of components in the plurality of barrels, the plurality of barrels being filled with liquid and detergent, and cascading the plurality of barrels at high speeds.

10. The method of claim 1, further comprising grinding each of the plurality of components to a desired size.

11. The method of claim 1, wherein the low-energy processing media used for cascading the plurality of components in the cascading machine under low-energy conditions consists essentially of the abrasive and water, and wherein the high-energy processing media used for cascading the plurality of components in the cascading machine under high-energy conditions consists essentially of water and detergent.

12. The method of claim 1, further comprising selecting a time and a spindle speed for the cascading machine based upon the material grade, size, and geometry of the plurality of components.

13. The method of claim 1, wherein the binder is cobalt.

14. The method of claim 1, wherein the plurality of components are cascaded at high-energy conditions resulting in hardness of the plurality of components increasing by 0.4 to 1.6 HRa and toughness of the plurality of components increasing by 2 to 2.5 times a pro-cascading value.

15. The method of claim 1, wherein heating the plurality of components to liquefy the binder includes heating the plurality of components under pressure to liquefy the binder.

16. A method of increasing the surface hardness of cemented tungsten carbide components, comprising:

cascading the plurality of components in a cascading machine in a low-energy processing media including an abrasive under low energy conditions; and cascading a plurality of tungsten carbide components in the cascading machine in a high-energy processing media different from the low-energy media which does not include an abrasive under high-energy conditions.

17. The method of claim 16, wherein the cascading machine is operated at a spindle speed of approximately 100 to 300 RPM during the high-energy conditions.

18. The method of claim 17, wherein the spindle speed is selected based upon an average mass of the plurality of components.

19. The meted of claim 16, further comprising selecting a spindle speed of the cascading machine based upon the material grade, size, and geometry of the plurality of components.

20. The method of claim 16, wherein the plurality of components is cascaded for approximately 20 minutes in the low-energy processing media and approximately 10 to 90 minutes in the high-energy processing media.

21. The method of claim 16, wherein the cascading machine comprises a plurality of barrels radially disposed around a spindle, each of the plurality of barrels being configured to contain at least a fraction of the plurality of components.

22. The method of claim 21, further comprising selecting a volume of each of the plurality barrels to control the amount of energy imparted to the plurality of components within the plurality of barrels.

23. The method of claim 21, wherein each of the plurality of barrels is axially, irrotationally coupled about an axis of the barrel parallel to a central axis of the spindle.

24. The method of claim 21, wherein the plurality of barrels comprise hexagonal barrels.

25. The method of claim 21, wherein cascading the plurality of components under high-energy conditions comprises placing the plurality of components in the plurality of barrels, the plurality of barrels being filled with liquid and detergent, and cascading the plurality of barrels at high speeds.

26. The method of claim 16, wherein the low-energy processing media used for cascading the plurality of components in the cascading machine under low-energy conditions consists essentially of an abrasive and water, and wherein the high-energy processing media used for cascading the plurality of components in the cascading machine under high-energy conditions consists essentially of water and detergent.

27. The method of claim 16, wherein the plurality of components are cascaded at high-energy conditions resulting in hardness of the plurality of components increasing by 0.4 to 1.6 ERa and toughness of the plurality of components increasing by 2 to 2.5 times a pro-cascading value.

28. A method, comprising:

cascading a plurality of tungsten carbide components in a cascading machine in a low-energy processing media consisting essentially of a cutting abrasive and water under low-energy conditions; and cascading the plurality of tungsten carbide components in the cascading machine in a high-energy processing media different from the low-energy media and consisting essentially of a detergent and water under high-energy conditions.

29. The method of claim 28, wherein the cascading machine is operated at a spindle speed of approximately 100 to 300 RPM during the high-energy conditions.

30. The method of claim 29, wherein the spindle speed is selected based upon an average mass of the plurality of components.

31. The method of claim 28, further comprising selecting a spindle speed of the cascading machine based upon the material grade, size, and geometry of the plurality of components.

32. The method of claim 28, wherein the plurality of components is cascaded for approximately 20 minutes in the low-energy processing media and approximately 10 to 90 minutes in the high-energy processing media.

33. The method of claim 28, wherein the cascading machine comprises a plurality of barrels radially disposed around a spindle, each of the plurality of barrels being configured to contain at least a fraction of the plurality of components.

34. The method of claim 33, further comprising selecting a volume of each of the plurality barrels to control the amount of energy imparted to the plurality of components within the plurality of barrels.

35. The method of claim 33, wherein each of the plurality of barrels is axially, irrotationally coupled about an axis of the barrel parallel to a central axis of the spindle.

36. The method of claim 33, wherein the plurality of barrels comprise hexagonal barrels.

37. The method of claim 33, wherein cascading the plurality of components under high-energy conditions comprises placing the plurality of components in the plurality of barrels, the plurality of barrels being filled with to high-energy processing media, and cascading the plurality of barrels at high speeds.

38. The method of claim 28, wherein the plurality of components are cascaded at high-energy conditions resulting in hardness of the plurality of components increasing by 0.4 to 1.6 HRa and toughness of the plurality of components increasing by 2 to 2.5 times a pre-cascading value.

39. The method of claim 28, wherein the plurality of cemented abrasive components includes tungsten carbide components.

40. The method of claim 28, wherein the plurality of cemented abrasive components includes polycrystalline diamond (PCD) components.

* * * * *

UNITED STATES PATENT AND TRADEMARK OFFICE

CERTIFICATE OF CORRECTION

PATENT NO. : 7,258,833 B2
APPLICATION NO. : 10/657896
DATED : August 21, 2007
INVENTOR(S) : John Franklin Kita et al.

It is certified that error appears in the above-identified patent and that said Letters Patent is hereby corrected as shown below:

In the Claims:

At column 9, claim number 5, line number 8, please replace the word [to] with the word -- the --.

At column 9, claim number 6, line numbers 10-11, please replace the phrase [about a axis of to barrel] with the phrase -- about an axis of the barrel --.

At column 9, claim number 14, line number 43, please replace the word [pro-cascading] with the word -- pre-cascading --.

At column 9, claim number 19, line number 62, please replace the word [meted] with the word -- method --.

At column 10, claim number 27, line number 34, please replace [ERa] with -- HRa --.

At column 10, claim number 27, line number 35, please replace the word [pro-cascading] with the word -- pre-cascading --.

At column 11, claim number 37, line number 11, please replace the word [to] with the word -- the --.

Signed and Sealed this
Thirtieth Day of August, 2011

David J. Kappos

David J. Kappos
*Director of the United States Patent and Trademark Office*